US006637785B2

(12) United States Patent
Sugimoto

(10) Patent No.: US 6,637,785 B2
(45) Date of Patent: Oct. 28, 2003

(54) HANDLE DEVICE

(75) Inventor: Naoyuki Sugimoto, Tokyo (JP)

(73) Assignee: Takigen Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/888,590

(22) Filed: Jun. 26, 2001

(65) Prior Publication Data

US 2001/0054824 A1 Dec. 27, 2001

(30) Foreign Application Priority Data

Jun. 26, 2000 (JP) ..... 2000-191559

(51) Int. Cl.[7] ..... E05B 3/00

(52) U.S. Cl. ..... 292/336.3; 292/335; 292/DIG. 30; 292/302; 70/207; 70/DIG. 31

(58) Field of Search ..... 292/336.3, 335, 292/DIG. 30, 39, 126, 134, 167, 170, 173, 100, 165, 300, 302; 70/207, 208, 120, DIG. 31, 209, 210, 211, 215, 462

(56) References Cited

U.S. PATENT DOCUMENTS

| | | | | | |
|---|---|---|---|---|---|
| 2,698,197 | A | * | 12/1954 | Jacobson | 292/336 |
| 3,045,465 | A | * | 7/1962 | Larson | 70/153 |
| 3,884,514 | A | * | 5/1975 | Praska | 292/11 |
| 4,554,807 | A | * | 11/1985 | Dolejs | 70/208 |
| 4,687,237 | A | * | 8/1987 | Bisbing | 292/78 |
| 4,913,476 | A | * | 4/1990 | Cook | |
| 4,930,325 | A | * | 6/1990 | Ramsauer | 292/337 |
| 5,347,834 | A | * | 9/1994 | Ramsauer | 70/120 |
| 5,873,274 | A | * | 2/1999 | Sauerland | 292/336.3 |
| 5,970,757 | A | * | 10/1999 | Ramsauer | 292/336.3 |
| 6,182,483 | B1 | | 2/2001 | von Kathen et al. | 70/208 |

FOREIGN PATENT DOCUMENTS

| | | | |
|---|---|---|---|
| GB | 2247714 | * | 9/1990 |
| GB | 000446566 | * | 9/1991 |
| GB | 000501803 | * | 9/1992 |
| GB | 2 259 940 | | 3/1993 |
| WO | WO 98/42938 | | 10/1998 |

* cited by examiner

*Primary Examiner*—Gary Estremsky
*Assistant Examiner*—Mark Williams
(74) *Attorney, Agent, or Firm*—Keil & Weinkauf

(57) ABSTRACT

A handle device is provided which enables easy and safety opening/closing of a door in a single step without rotation of the handle. The handle device is installed on a casing having a door and a casing frame, and includes a door unit on a door, and a casing frame unit having a hook on a casing frame. The door unit includes a handle section having a handle which can be lifted up or pressed down relative to the door, and a lock which can lock the handle in its lowest position, and a sliding section having a sliding member slidable along the door. The sliding member engages with the handle to slide in response to the motion of the handle, and has a slot which engages with and disengages from the hook in response to the slide of the sliding member corresponding to the motion of the handle.

4 Claims, 7 Drawing Sheets

HANDLE DEVICE

BACKGROUND OF THE INVENTION

1. Field of the invention

This invention relates to a handle device for opening/closing and locking/unlocking a door of a casing of a switching board, a distribution board, a control panel, a cubicle, a cabinet, a rack, and the like.

2. Description of Related Art

A casing having a door and a casing frame is often provided with a handle device for opening/closing and locking/unlocking the door. The handle device is normally composed of a door unit including a handle fitted to the door, and a casing frame unit including a hook member fitted to the casing frame. A conventional handle device of this type requires rotational operation of the handle in a plane parallel to the door surface by a user for opening/closing the door.

However, with such a conventional handle device, a user may face a number of problems. For instance, projections on the surface of the door located near the rotational area of the handle tend to prevent easy opening and closing of the door. The user can hit the projection with his hand in rotating the handle and/or his fingers can be caught between the projection and the handle. Further, the conventional handle device has a structure such that when opening the door the user has to lift the handle up, turn it in a plane parallel to the door surface, and then pull it out to actually open the door. In short, opening the door requires three steps, and closing the door also requires three steps.

SUMMARY OF THE INVENTION

It is an object of the present invention to provide a handle device with which both opening and closing a door involve only a single step, with which the user can open and close a door safely and easily even when the door has a projection on its surface having the handle, and with which the locking operation can be easily performed.

According to the invention, there is provided a handle device to be installed on a casing having a door and a casing frame, said handle device comprising:

a door unit to be mounted on a door, and a casing frame unit having a hook member to be mounted on a casing frame, said door unit including a handle section and a sliding section, said handle section including a handle capable of being lifted up or pressed down with respect to a door surface, and a lock capable of securing and locking said handle in its pressed-down position, said sliding section including a sliding member linearly slidable in two opposite directions along the surface of the door, wherein said sliding member is in engagement with said handle so that the sliding member slides in either of said two directions in response to said handle being lifted up or pressed down, wherein said sliding member has a hook engaging slot, said hook engaging slot engaging with said hook member when said sliding member slides in one of said two directions corresponding to the handle being pressed down, and disengaging from said hook member when said sliding member slides in the other of said two directions corresponding to the handle being lifted up.

Thus, according to the invention, a single step of lifting up or pressing down the handle causes disengagement or engagement of the hook member on the casing frame with or from the hook engaging slot in the sliding member to allow opening and closing the door. In addition, with the hook member in engagement with the hook engaging slot, the door can easily and reliably be locked and unlocked by using a lock.

According to one aspect of the present invention, the sliding member has two opposite extensions along a length of the handle section, and is provided with not less than three of said hook engaging slots, each of said extensions having at least one of said hook engaging slots.

In an example of this embodiment, the sliding member includes a slide bar having a slide block connected thereto and at least one of said hook engaging slots, and flat bars as said extensions each connected to either of the slide bar or the slide block and having at least one of the hook engaging slots.

With this embodiment, the door may be locked to the casing frame at a plurality of locations, including those in the extensions of the sliding member beyond the handle section. Thus the door may be locked in a more stable manner.

According to another aspect of the present invention, the door unit includes a guide member for defining directions and limits of sliding of the sliding member.

With this embodiment, the directions and limits of the sliding motion of even the sliding member with the extensions may be controlled as desired.

BRIEF DESCRIPTION OF THE DRAWINGS

The above and other objects, features and advantages of the present invention will become apparent from the following detailed description of the preferred embodiments of the invention in conjunction with the accompanying drawings, in which.

PREFERRED EMBODIMENTS OF THE INVENTION

Now, the present invention will be described with reference to the accompanying drawings that illustrate a preferred embodiment of the invention. The invention is not limited thereto.

Figure 1:
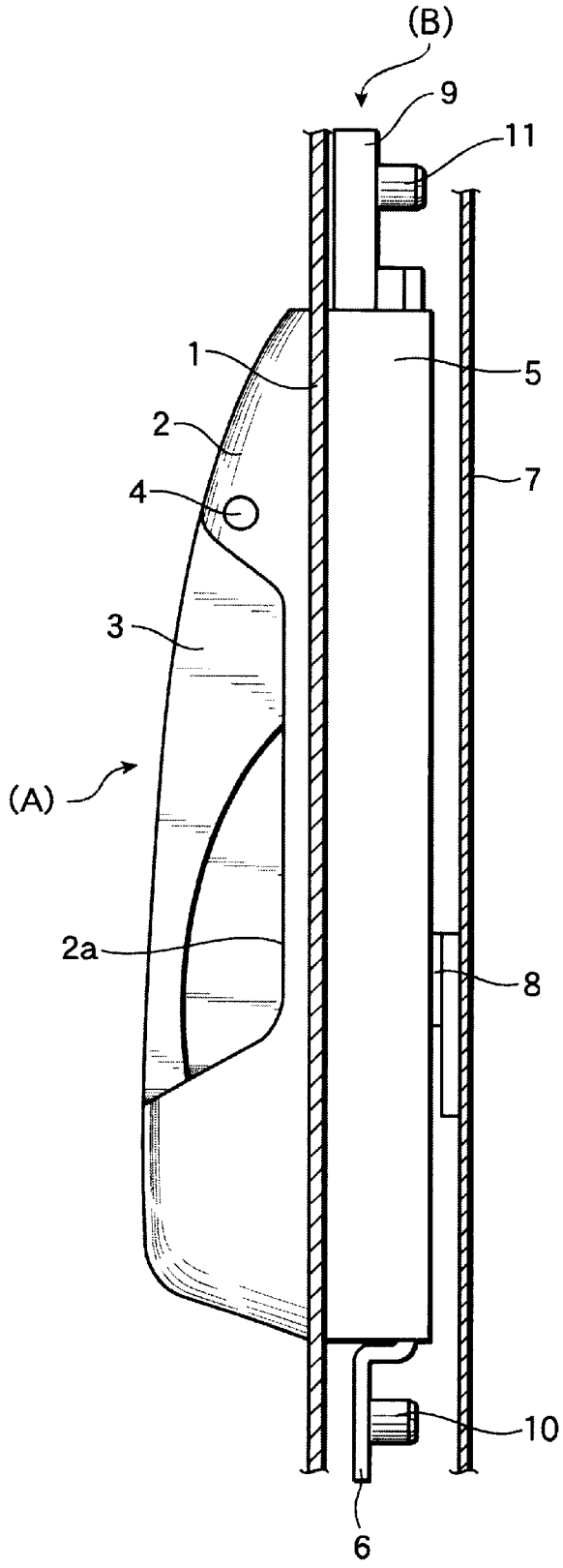
FIG. 1 is a side view of an embodiment of the handle device according to the invention, installed on the door and the casing frame of a casing.

FIG. 1 is a side view of an embodiment of the handle device according to the invention, installed on a door 1 and a casing frame 7 of a casing. A door unit includes a handle section (A) integrated with a sliding section (B), and mounted on the door 1. A casing frame unit includes a hook member 8 fixed on the casing frame 7.

The handle section (A) includes a handle 3 that can be pivotably lifted up or pressed down with respect to the surface of the door 1 around a shaft pin 4 operating as a fulcrum, and a handle cover 2 having a recess 2*a* for accommodating the handle 3 when pressed down. The sliding section (B) includes a guide frame 5, a slide bar 6 partly contained in the guide frame 5, and a slide block 9. The slide bar 6 and the slide block 9 are connected to each other (see FIG. 2) and may be provided at each free end with connection pins 10 and 11 projecting therefrom, respectively, for connecting a flat bar, which will be described hereafter.

Now, the structure of the handle device shown in FIG. 1 will be described in greater detail with reference to FIGS. 2 through 6.

Figure 2:
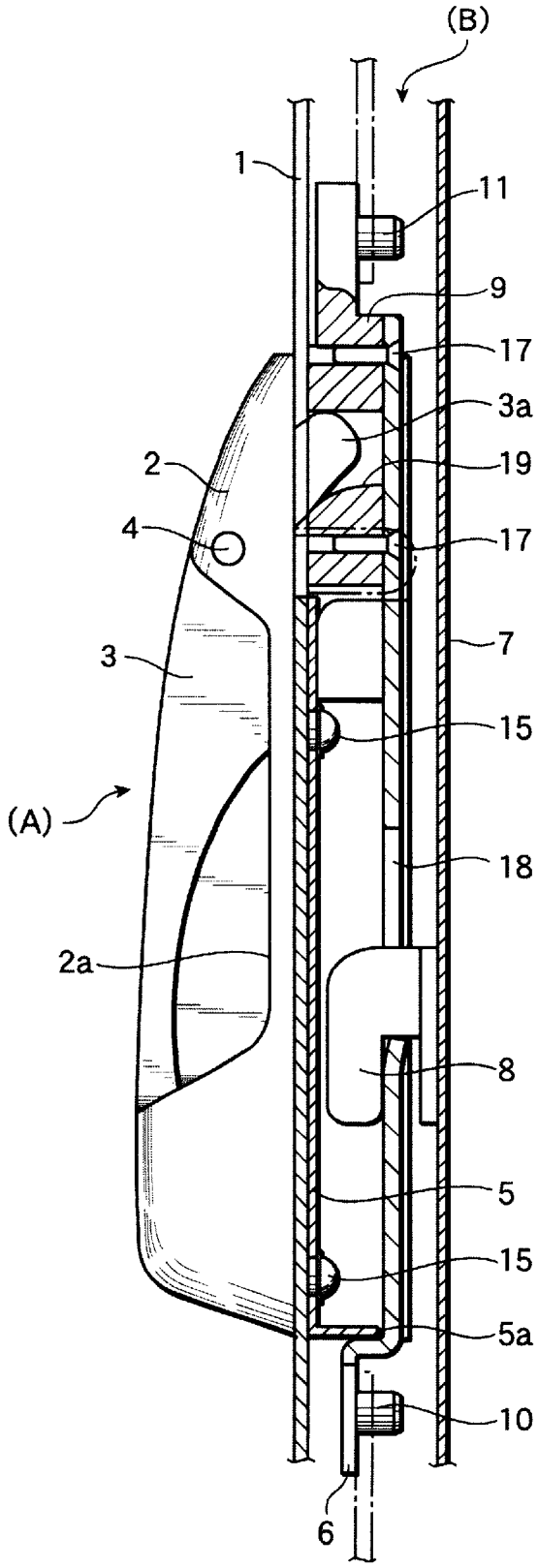
FIG. 2 is a side view partially in section of the embodiment of the handle device as shown in FIG. 1.
Figure 3:
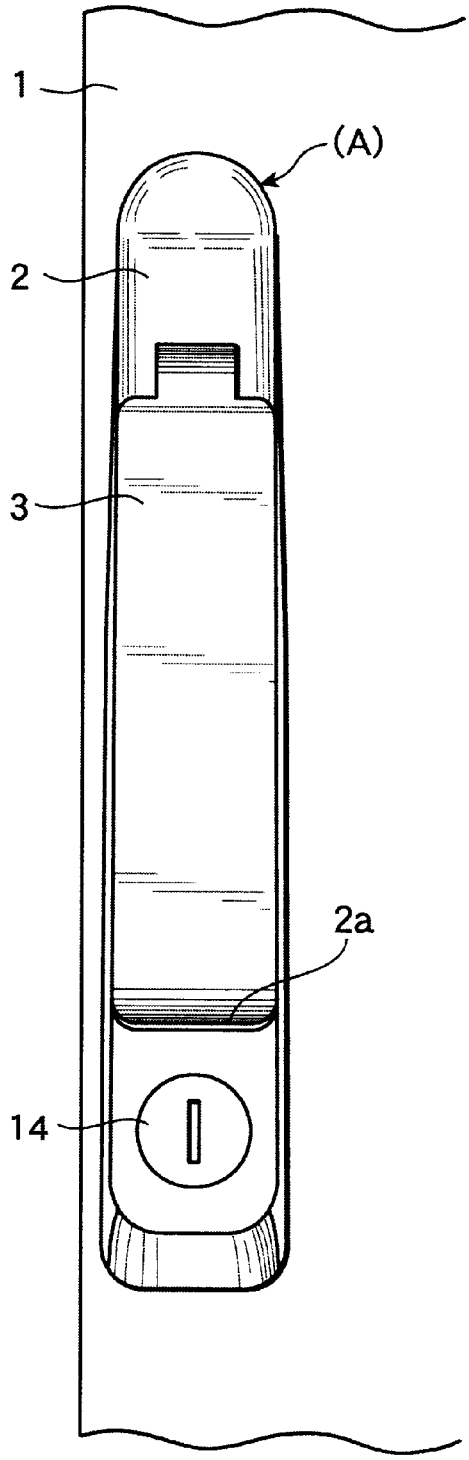
FIG. 3 is a front view of the embodiment of FIG. 1.
Figure 4:
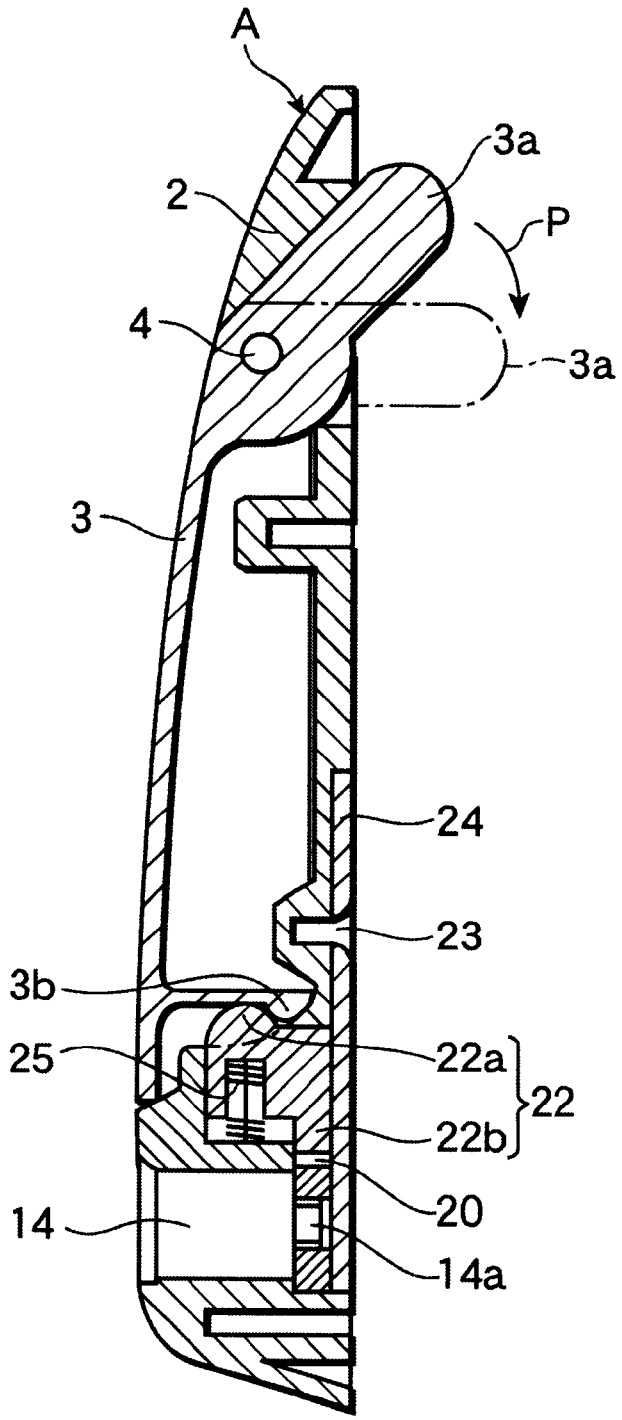
FIG. 4 is a sectional view of the handle section of the handle device of FIG. 1.
Figure 5:
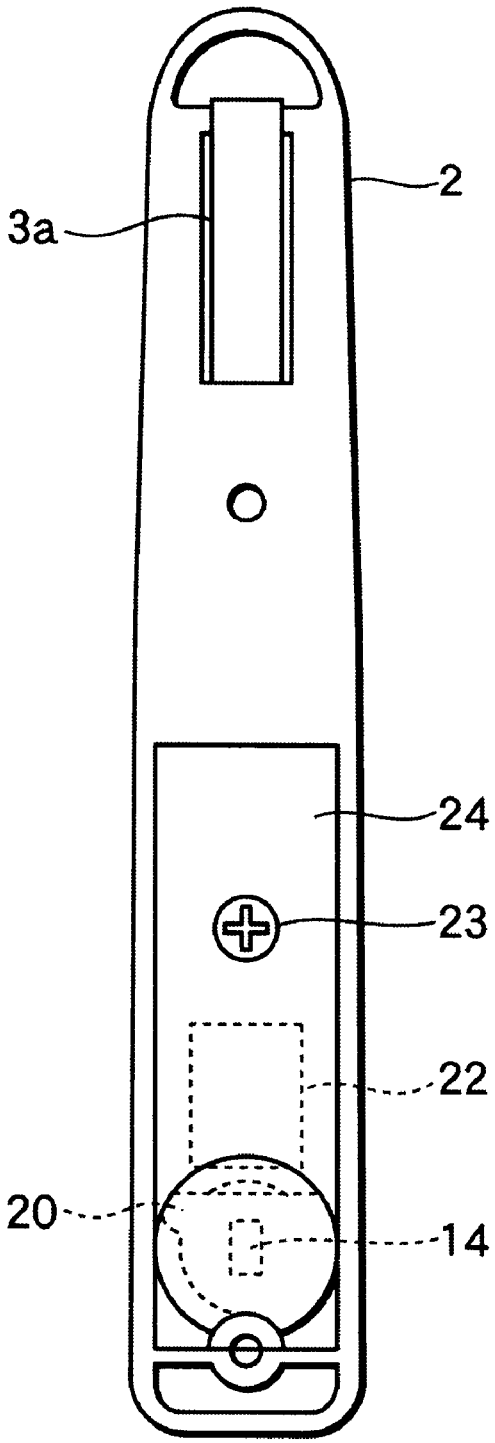
FIG. 5 is a rear view of the handle section of FIG. 4.

Referring first to FIG. 2, the handle section (A) and the guide frame 5 of the sliding section (B) are fixed to the door 1 by means of a plurality of screws 15. The handle 3 has a handle pawl 3*a* in its upper end portion supported by the shaft pin 4, and in the opposite lower end portion with an engaging projection 3*b* for keeping the handle 3 in position when pressed down as shown in FIG. 4. As shown in FIGS. 3 through 5, a lock 14 and a dead lock member 22 are held in contact with the inner surface of the handle cover 2 in the lower end portion thereof by means of a supporting plate 24 rigidly secured to the rear face of the handle cover 2 with a screw 23.

The lock 14 has a key slot opened to the front side thereof, through which a corresponding key can be inserted, and is provided at its base with a rotary shaft 14*a* and an eccentric cam 20. The rotary shaft 14*a* is rotated when the key is turned in the key slot, in response to which the eccentric cam 20 rotates around the eccentric shaft 14*a*.

The dead lock member 22 has a locking projection 22*a* to be engaged with the engaging projection 3*b* of the handle 3, and an operating projection 22*b* to be pushed by the eccentric cam 20 as the latter rotates. A spring 25 is provided to thrust the dead lock member 22 upward so that slight engagement of the locking projection 22*a* with the engaging projection 3*b* is maintained when the dead lock member 22 is not pushed by the eccentric cam 20.

When the lock 14 is not set, the locking projection 22*a* of the dead lock member 22 lightly engages with the engaging projection 3*b* of the handle 3 under the action of the spring 25 as shown in FIG. 4. This holds the handle 3, when pressed down, within the recess 2*a* of the handle cover 2. When the key is inserted into the lock 14 and turned to rotate the eccentric cam 20, the cam 20 pushes the operating projection 22*b* upward. This causes upward forced slide of the dead lock member 22 on the supporting plate 24 to tighten the engagement of the locking projection 22*a* and the engaging projection 3*b* of the handle 3. When the lock 14 is set in this tightly engaged state, the handle 3 can no longer be lifted up and the door 1 is locked in its closed position.

As shown in FIG. 2, the guide frame 5, mounted on the door 1 together with the handle section (A), slidably accommodates a slide bar 6 and a slide block 9 attached to the bar 6 with screws 17. The slide bar 6 has an elongate slot 18, in which the hook member 8 fixed on the casing frame 7 releasably engages. The free end of the slide bar 6 not connected to the slide block 9 extends to the outside of the guide frame 5 through a guide slot 5*a* formed in the guide frame 5. As shown in FIG. 2, the free end of the slide bar 6 extending out of the guide frame 5 has an L-shaped configuration. This L-shaped section prevents the slide bar 6 from passing through the guide slot 5*a*, and restricts the sliding motion of the slide bar 6 and the slide block 9.

The slide block 9 has a pawl receiving hole 19 with a partly curved profile for receiving the handle pawl 3*a* of the handle 3. The handle pawl 3*a* is inserted into the pawl receiving hole 19 and held there as shown in FIG. 2.

Figure 6:
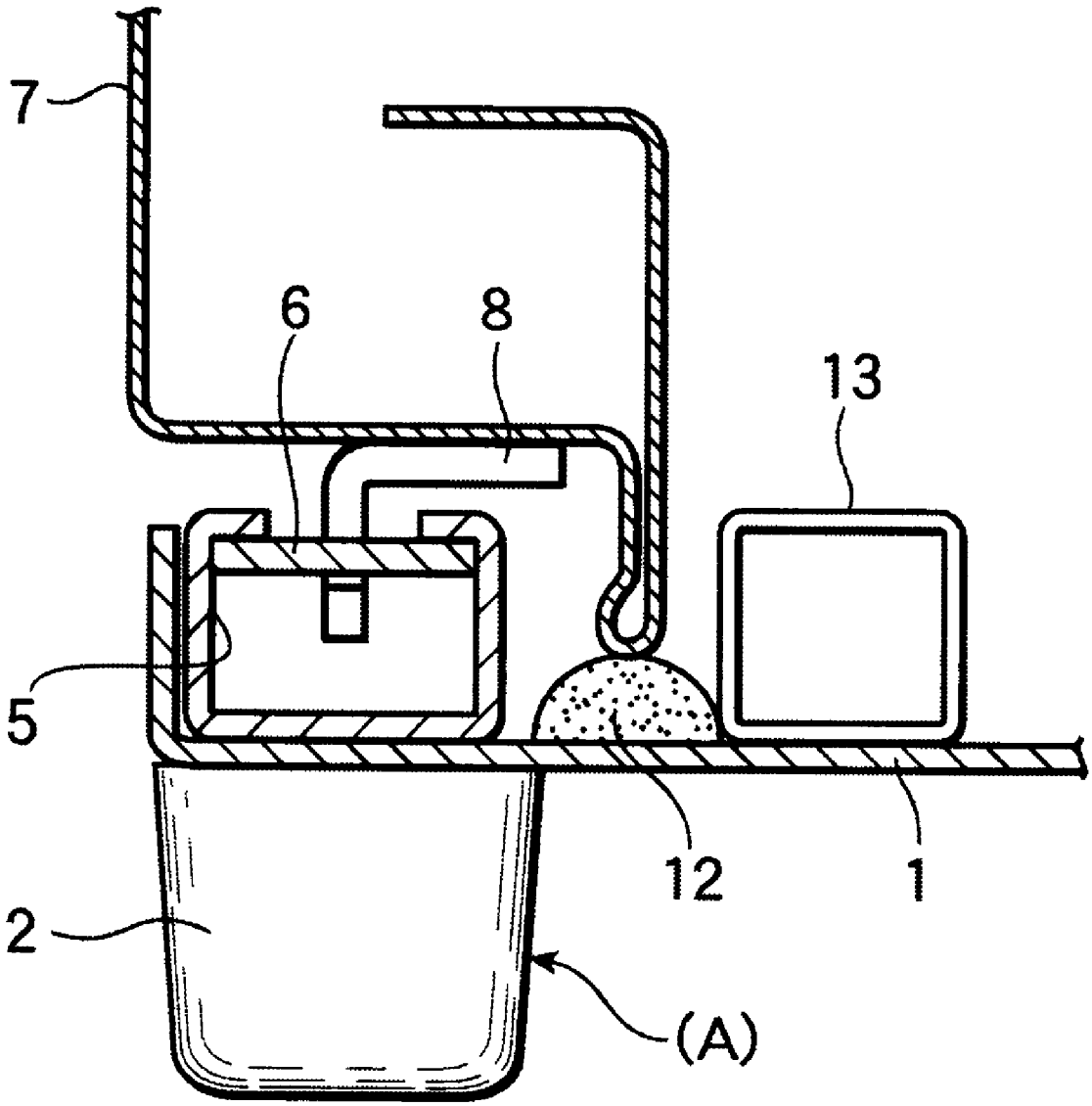
FIG. 6 is a cross sectional view of FIG. 1.

As shown in FIG. 6, a long gasket (packing) 12 is attached on the rear surface of the door 1 in an area near the guide frame 5. The gasket 12 is arranged in such a way that when the door 1 is closed it comes into contact with a projecting edge 7*a* projecting from a part of the casing frame 7. A reinforcement frame 13 is also arranged on the rear surface of the door along the gasket 12.

Now, the operation of the above described embodiment of the handle device will be described below.

With the handle device as shown in FIGS. 1 to 3, when the handle 3 is pressed down and thus accommocated in the recess 2*a* of the handle cover 2, the door 1 of the casing is held closed. Under this condition the handle pawl 3*a* of the handle 3 is in a position with its tip slightly inserted and received in the pawl receiving hole 19 of the slide block 9, and the slide block 9 and the slide bar 6 are held in position as shown in FIG. 2. The L-shaped hook member 8 fixed on the casing frame 7 is placed in the elongate slot 18 in the slide bar 6, and engages with the bar 6 as shown in FIG. 2.

When the key is inserted into the lock 14 and turned in the locking direction, the rotary shaft 14*a* is rotatably driven to rotate the eccentric cam 20, which in turn pushes the operating projection 22*b* of the dead lock member 22 in an upward direction (FIG. 4). As a result, the locking projection 22*a* of the dead lock member 22 is brought into a tight engagement with the engaging projection 3*b* of the handle 3, as shown in FIG. 4, to prevent the handle 3 from pivoting around the shaft pin 4. Accordingly, the door 1 is locked in the closed position.

Now, the operation of the handle device for opening the door 1 from the deadlocked state will be described below.

First the key is inserted into the lock 14 and turned in the deadlock releasing direction. This rotates the eccentric cam 20 as shown in FIGS. 4 and 5 to release the upward thrust of the cam 20 against the operating projection 22*b* of the dead lock member 22. As a result, the tight engagement of the locking projection 22*a* of the dead lock member 22 with the engaging projection 3*b* of the handle 3 is released. This engagement is now only lightly maintained by the spring 25 so that the limitation of the pivotal operation of the handle is released.

Then, the handle 3 is pivotably lifted up from the surface of the door 1, which causes the movement of the handle pawl 3*a* in the direction of arrow P in FIG. 4. This movement is accompanied by insertion of the handle pawl 3 deep into the pawl receiving hole 19 of the slide block 9 shown in FIG. 2. The handle pawl 3 advances, pressing the slide block 9 downward, which causes the slide bar 6, interlocked with the slide block 9, to also slide downward. As a result of this sliding movement of the slide bar 6, the L-shaped hook member 8 that has been engaged with the slide bar 6 in the elongate hole 18 is released from the engaged state. Thus, the door 1 can be opened by the single step of lifting and pulling the handle 3 from the surface of the door 1.

With the conventional handle device described earlier, for opening the door, the user has to lift up the handle, turn it in a plane parallel to the door surface, and then pull it to actually open the door. However, the handle device according to the invention is designed to eliminate the rotational operation of the handle in a plane parallel to the door surface, and a corresponding structure for such rotational operation. As a result, the handle device of the present invention can avoid the problems mentioned above encountered in handle operation and rotation with a relatively simple structure.

Figure 7:
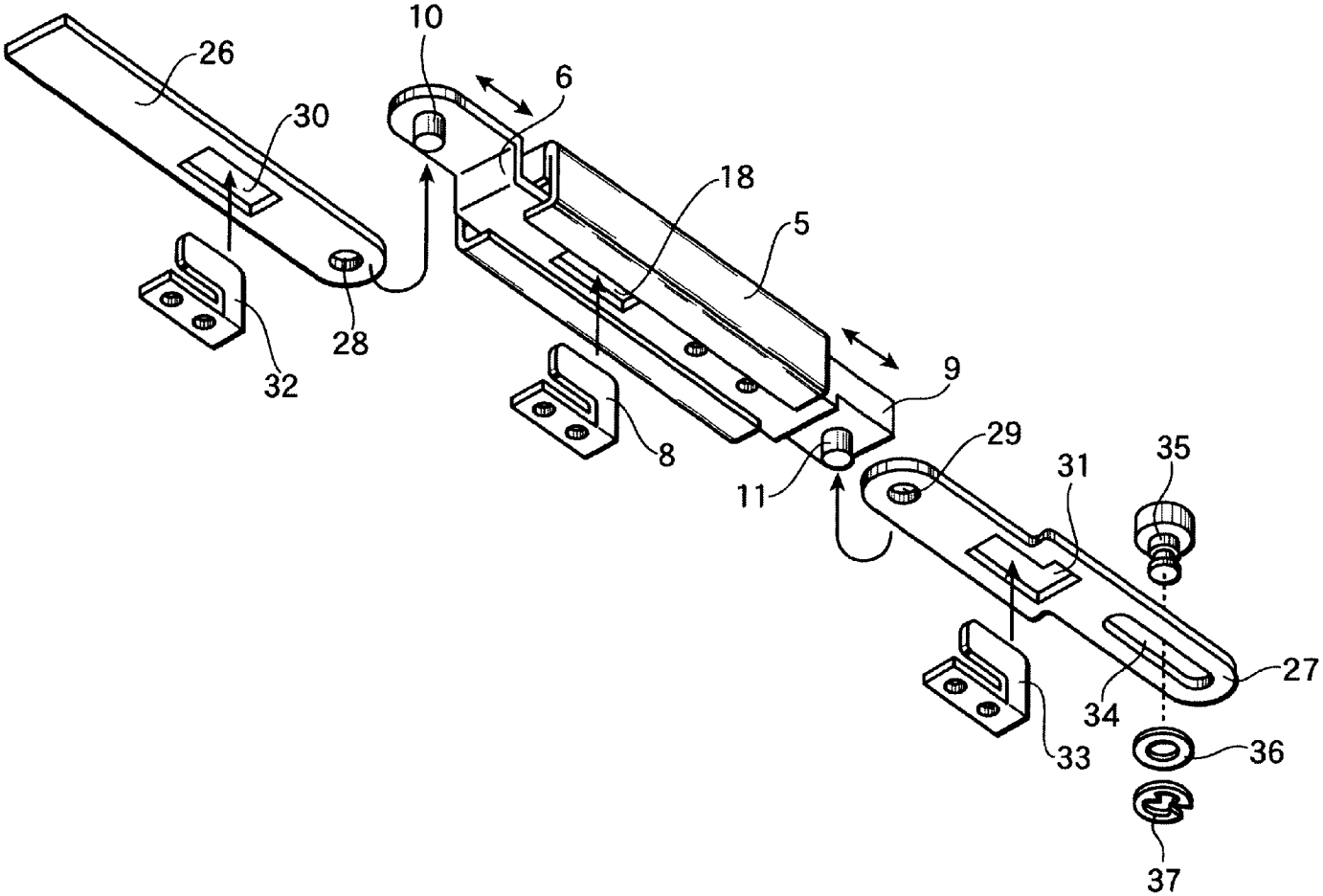
FIG. 7 is an exploded perspective view of the sliding section of the handle device according to another embodiment of the present invention, wherein the flat bars are added to the sliding section shown in FIG. 2.

Now, another embodiment of the invention, wherein flat bars 26 and 27 are connected to the slide bar 6 and the slide block 9 shown in FIG. 2, will be described below by referring to FIG. 7.

The flat bars 26 and 27 have pin holes 28 and 29, respectively, for receiving and rigidly holding connection pins 10 and 11 provided on the slide bar 6 and the slide block 9, respectively. The bars 26 and 27 also have elongate slots 30 and 31, respectively, in which hook members 32 and 33 fixed on the casing frame 7 releasably engage. The flat bar 27 is additionally provided with an elongate guide hole 34. This hole 34 receives a guide pin 35 which is fixed on the rear surface of the door by welding or the like means and projects therefrom. Once the guide pin 35 is fitted in the elongate guide hole 34 by means of a washer 36 and an E-ring 37, the flat bar 27 can slide in a predetermined direction within a predetermined range guided by the elongate guide hole 34 without being detached from the guide pin 35. The flat bar 26 may also be provided with a guide pin and an elongate hole similar to the guide pin 35 and the elongate hole 34.

This embodiment of the handle device including the flat bars 26 and 27 functions in basically the same way as the above described embodiment. However, in this embodiment, since the hook members 32 and 33 are engaged with their respective elongate slots 30 and 31 arranged in the flat bars 26 and 27 when the door is closed, the closed state of the door 1 is secured by means of a plurality of hook members. Further, such a plurality of hook members may engage with the sliding section in its extensions along the length of the handle section, so that the reliability of the lock is further improved.

In the handle device according to the invention, the sliding member is made to slide in two opposite directions along the door in response to the lifting up and pressing down of the handle. Depending on the position of the sliding member, the slot provided through the sliding member is brought into engagement with or disengagement from the hook member fixed on the casing frame. When the hook member is in engagement with the elongate slot, pivotal operation of the handle may be prevented by means of the lock. Thus opening and closing as well as locking and unlocking of the door can be achieved simply by lifting up or pressing down the handle device of the present invention. In addition, the locked state of the door may be easily secured by means of the lock.

Further, as the flat bars are connected to the sliding member for extending the sliding member along a length of the handle section, and not less than three hook engaging slots are provided therein, a plurality of hook members for the door lock may be provided on the casing frame, to thereby further stabilizing the locking state of the door.

While there has been described what are at present considered to be preferred embodiments of the invention, it will be understood that various modifications may be made thereto, and it is intended that the appended claims cover all such modification as fall within the true spirit and scope of the invention.

What is claimed is:

1. A handle device to be installed on a casing having a door and a casing frame, said handle device comprising:

a door unit to be mounted on a door, and a casing frame unit having a hook member to be mounted on a casing frame, said door unit including a handle section and a sliding section, said handle section including a handle capable of being lifted up or pressed down with respect to a door surface, and a lock capable of securing and locking said handle in its pressed-down position, said sliding section including a sliding member linearly slidable in two opposite directions along the surface of the door, wherein said sliding member is in engagement with said handle so that the sliding member slides in either of said two directions in response to said handle being lifted up or pressed down, wherein said sliding member has a hook engaging slot, said hook engaging slot engaging with said hook member when said sliding member slides in one of said two directions corresponding to the handle being pressed down, and disengaging from said hook member when said sliding member slides in the other of said two directions corresponding to the handle being lifted up, wherein said sliding member has two opposite extensions along a length of said handle section, and is provided with not less than three of said hook engaging slots, each of said extensions having at least one of said hook engaging slots, and wherein said sliding member includes a slide bar having a slide block connected thereto and at least one of said hook engaging slots, and flat bars as said extensions each connected to either of said slide bar or the slide block and having at least one of said hook engaging slots.

2. The handle device according to claim 1, wherein said door unit includes a guide member for defining directions and limits of sliding of the sliding member.

3. The handle device according to claim 1, wherein said handle has a handle pawl and said sliding member has a pawl receiving hole, said pawl receiving hole being in engagement with said handle pawl.

4. The handle device according to claim 1 further comprising a dead lock member having a locking projection and associated with said lock, wherein said handle has an engaging projection in its lower end portion, and wherein said locking projection engages with said engaging projection to prevent said handle from being lifted up, when said lock is set.

* * * * *